United States Patent [19]

Thill

[11] 3,941,180

[45] Mar. 2, 1976

[54] SECTIONAL DOOR AND GUARD RAIL ASSEMBLY

[75] Inventor: Timothy N. Thill, Forest City, Iowa

[73] Assignee: Winnebago Industries, Inc., Forest City, Iowa

[22] Filed: Dec. 30, 1974

[21] Appl. No.: 537,257

[52] U.S. Cl. ..... 160/229 R; 49/383; 160/201; 160/232

[51] Int. Cl.[2] ..... E05D 15/38

[58] Field of Search ..... 160/229, 199, 206, 40, 160/41, 207, 232, 201; 49/383, 501, 503, 397

[56] References Cited

UNITED STATES PATENTS

| | | | |
|---|---|---|---|
| 2,880,796 | 4/1959 | Stroup | 160/232 |
| 2,907,383 | 10/1959 | Kloote et al. | 160/232 X |
| 2,924,861 | 2/1960 | Viets | 49/503 X |
| 3,104,699 | 9/1963 | Wolf et al. | 160/232 X |
| 3,198,242 | 8/1965 | Crosswell | 160/229 R X |
| 3,319,697 | 5/1967 | Krohn | 160/229 R |
| 3,347,305 | 10/1967 | Urbanick | 160/229 R X |
| 3,511,301 | 5/1970 | Graham et al. | 160/232 X |

*Primary Examiner*—Philip C. Kannan
*Attorney, Agent, or Firm*—Burd, Braddock & Bartz

[57] ABSTRACT

A sectional door such as a garage door of the type having a plurality of hingedly connected panels adapted to be pivoted relative to one another generally about interior edges of facing lateral ends during opening and closure of the door. One of each pair of facing ends of the panels is equipped with a first rail having a front wall and defining an interior pocket. The facing end of the adjacent panel is equipped with a second rail having an arcuate segment extending into the pocket of the first rail in overlapping relationship to the front wall thereof when the adjacent panels are in aligned orientation. When the adjacent panels are pivoted relative to one another generally about their interior edges, the arcuate segment of the second rail moves outward of the pocket of the first rail to span the angular gap formed between the facing ends of the adjacent panels.

16 Claims, 4 Drawing Figures

FIG. 1
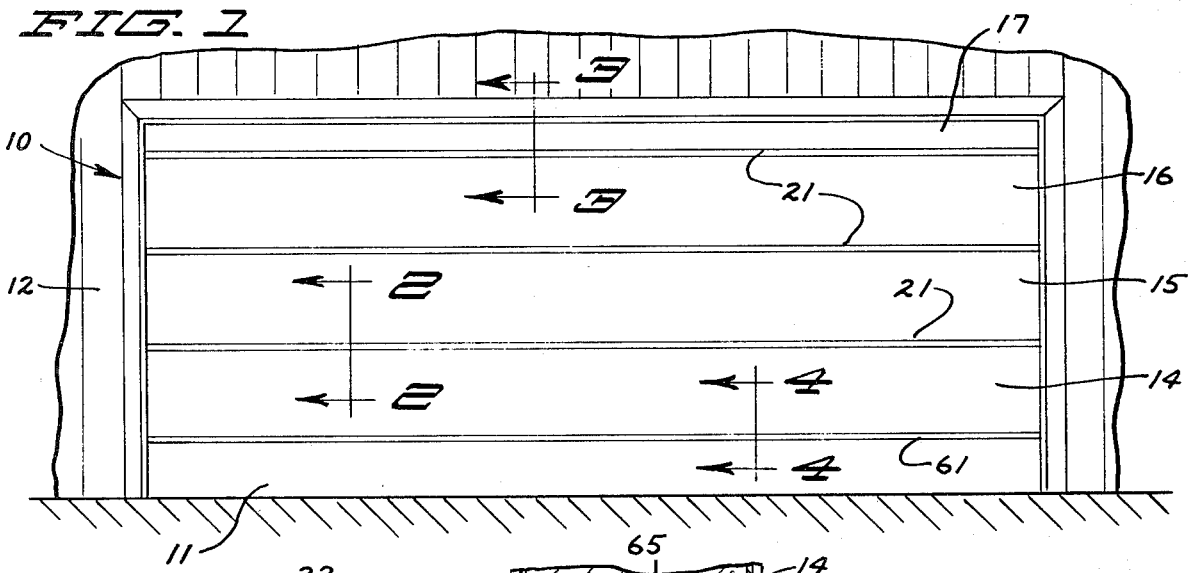
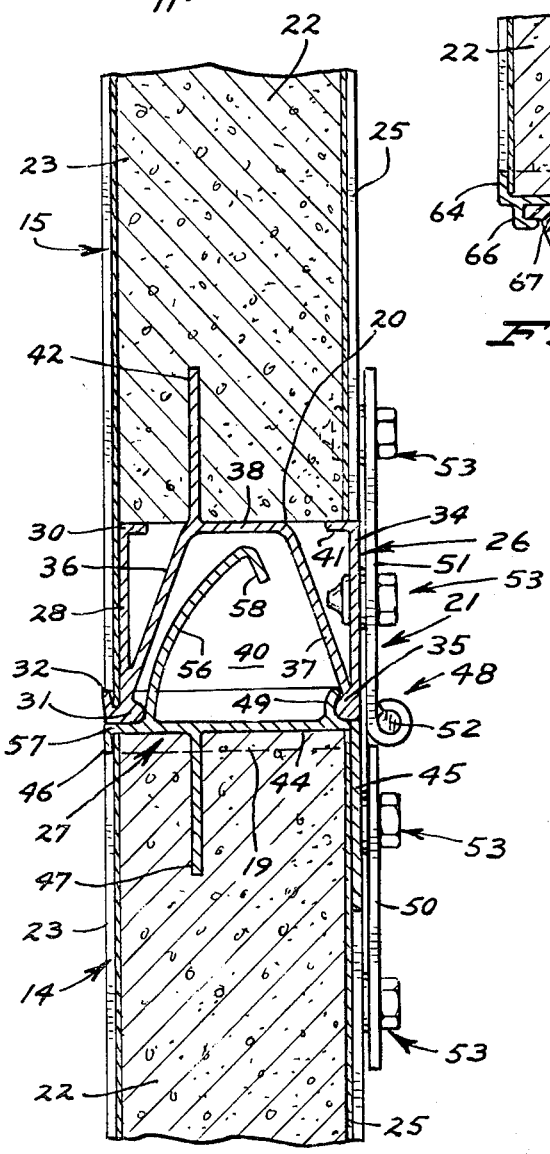
FIG. 2
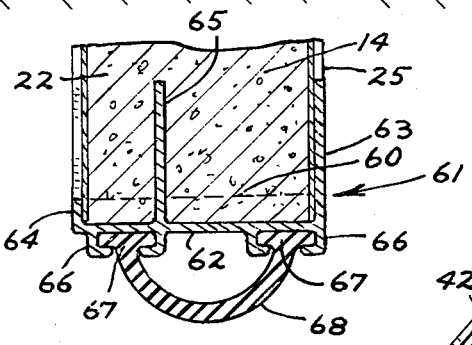
FIG. 4
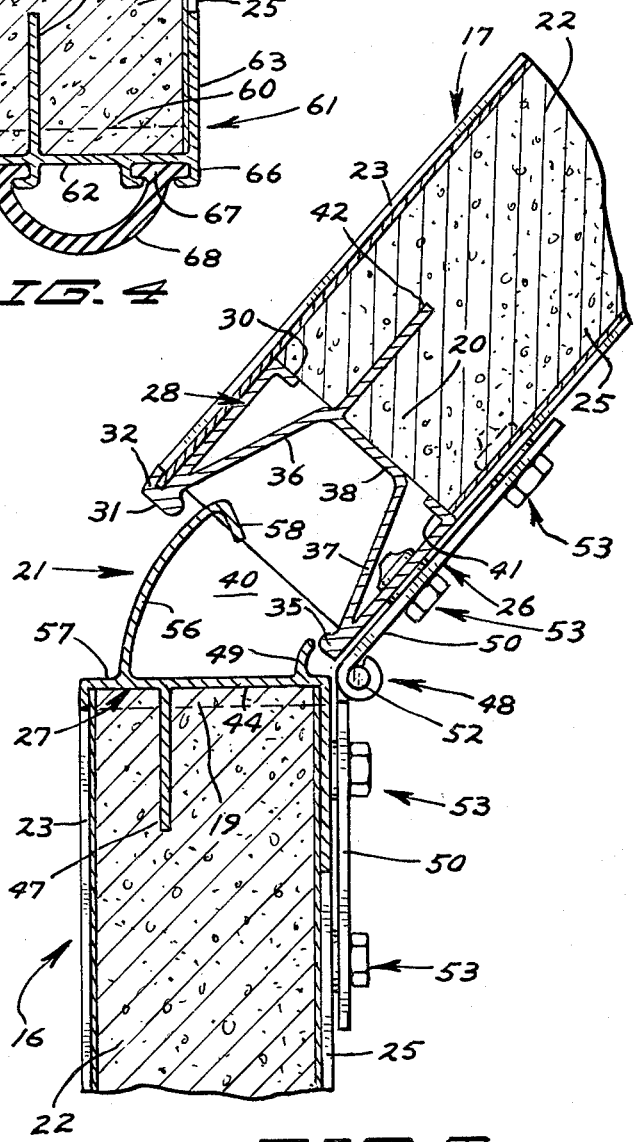
FIG. 3

SECTIONAL DOOR AND GUARD RAIL ASSEMBLY

BACKGROUND OF THE INVENTION

Garage doors and vehicle body doors are commonly formed of a plurality of horizontal sections or panels hingedly connected along horizontal axes. The door is mounted on a suitable track assembly for movement between a vertical, closed position closing the garage opening, and a horizontal, open position allowing access to the garage interior. The door is formed of a plurality of hinged panels to facilitate negotiation of the orientation change between the vertical and horizontal positions. In moving between the vertical and horizontal positions, a sizable angular gap is formed and then closed between facing ends of adjacent panels. The formation and closure of such a gap is a potential source of danger. Serious injury may result if a finger is captured in the gap when the door is being closed. Furthermore, the gap allows entry of rain, snow, dirt, and the like, which might impede operation of the door and obstruct the hinge mechanism. In the wintertime, the gap might permit ice formation between adjacent panels thus impeding operation of the door. Examples of this type of door structure are shown in U.S. Pat. Nos. 3,017,218; 3,104,699 and 3,457,983.

SUMMARY OF THE INVENTION

The invention relates to a sectional door and a guard rail assembly generally for sectional doors and in particular for doors of the type having a plurality of horizontal panels hingedly connected for relative pivotal movement about a horizontal axis proximate an interior or pivoting edge of the panels. The guard rail assembly is assembled at the joint of facing lateral ends of adjacent panels. A first rail is assembled to the lateral end of a first panel, and is substantially coextensive with the breadth thereof. The first rail has a front wall constituting an extension of the side of the first panel opposite the interior edge proximate the pivoting axis. Behind the front wall, the first rail defines a pocket openly facing a second rail assembled to the facing lateral end of a second panel. An arcuate segment extends from the second rail into the pocket of the first rail. The arcuate segment has a contour in conformity with the path of travel of the lower end of the front wall of the first rail whereby upon pivotal movement of the first panel relative to the second panel, the arcuate segment spans the angular gap produced between the panel ends. The arcuate segment serves as a shield at the joint between the panels to prevent entry of a finger or foreign matter such as snow, sleet, dirt, or the like. In addition, the rails provide strength and rigidity to the door panels, allowing the material of the panels to be of economic, lightweight material. In a preferred embodiment, the panels are formed of an expanded foam plastic material covered on one side by a metal skin and on the other side by a layer of wood. Ribs attached to the guard rails extend into the expanded plastic material to secure the rails to the panels.

An object of the invention is to provide a sectional door having a plurality of hingedly connected panels and means to prevent entry of foreign matter at the panel joints during opening and closure of the door. A second object is to provide guard rails for such a door providing a shield at the juncture of adjacent panels to prohibit the entry of foreign matter. A further object of the invention is to provide such guard rails which provide strength and support to individual door panels. A yet further object of the invention is to provide such a sectional door having panels formed of expanded foam plastic material. Further objects of the invention will become apparent upon the following description.

IN THE DRAWINGS

FIG. 1 is a front elevational view of a garage door constructed according to the present invention assembled in a garage;

FIG. 2 is an enlarged sectional view of a portion of the garage door of FIG. 1 taken along the line 2—2 thereof;

FIG. 3 is an enlarged sectional view of a portion of the garage door of FIG. 1 taken along the line 3—3 thereof; and FIG. 4 is an enlarged sectional view of the garage door of FIG. 1 taken along the line 4—4 thereof.

DESCRIPTION OF PREFERRED EMBODIMENT

Referring to the drawings, there is shown in FIG. 1 a garage door 10 according to the present invention installed in the conventional opening 11 of a garage 12. Garage door 10 is mounted on a suitable track assembly (not shown) within garage 12 for movement between a vertical closed position and a raised horizontal open position. Garage door 10 is comprised of a plurality of horizontal panels 14–17, vertically aligned when the door 10 is in the closed position. Adjacent panels are hingely connected to one another along the lateral ends thereof for relative rotation about a horizontal axis upon opening and closure of the door 10. As a panel approaches the top of garage opening 11, it must negotiate a 90° turn from a vertical to a horizontal position. During such a turn, an angular gap is formed between the lateral ends of adjacent panels. The panels 14–17 are equipped with guard rails of the present invention which close the angular gap to prohibit entry of foreign matter such as snow, dirt, rain, and the like. The guard rails of the present invention also prevent fingers from getting caught in the gap as the gap closes upon closure of the door.

Referring to FIG. 2, there are shown adjacent panels 14, 15 of door 10 having facing lateral ends 19, 20 equipped with a guard rail assembly of the invention, indicated generally at 21. Door panel 14 has a core 22 of an expanded plastic foam material such as polyurethane or polystyrene, or the like. The thermoplastic foam is economical, durable and thermally insulative. An outer skin 23 of metal or the like is adhered to the front of core 22 to provide protection against the elements. The inner side of core 22 of door panel 14 is covered by an expanse of rigid material such as a layer 25 of wood to add rigidity to the core 22 and provide a measure of protection. Panel 15, and likewise the remaining panels, also include a core 22 of expanded plastic foam material with an outer protective skin 23 preferably of metal or the like and an inner expanse comprised of a layer of supportive material such as wood.

Rail assembly 21 includes a first rail 26 and a second, cooperating rail 27. First rail 26 is mounted to the lateral end 20 of door panel 15 coextensive with the breadth of panel 15. A front wall 28 of rail 26 is constituted as an extension of the front side of panel 15 and has an inwardly turned ledge 30 in abutting relationship to the exterior edge of the lateral end 20 of panel 15. The opposite end of front wall 28 terminates in a beaded, inwardly facing foot 31. Front skin 23 of panel 15 overlaps the front wall 28 of first rail 26 and is secured at the end in a notch opposite foot 31 formed by a ridge 32 and the end of wall 28. A rear wall 34 of first rail 26 overlaps the rear side of door panel 15 and extends away therefrom parallel to the front wall 28, terminating in a rear beaded foot 35. A front leg 36 extends angularly inward from the front foot 31 toward end 20 of panel 15, and a rear leg 37 extends angularly inward from the rear foot 35 toward the end of panel 23. The front and rear legs are connected by a platform 38 which abuts against the end 20 of panel 15. The front and rear legs 36, 37 and platform 38 provide a U-shaped channel defining a pocket 40 of first rail 26.

A ledge 41 extends inward from the rear wall 34 and abuts the interior edge of lateral end 20 of panel 15. Platform 38 together with front and rear ledges 30, 41 provide a support base for the lateral end 20 of the panel 15. A rib 41 extends from the platform 38 into the core 22 of the panel 15 to firmly secure first rail 26 to the panel 15. First rail 26 is coextensive with the lateral end 20 of panel 15 and is preferably formed of a rigid material such as an extruded aluminum to provide a durable end frame member for the panel 15.

Second rail 27 of rail assembly 21 includes a flat base 44 abutting the lateral end 19 substantially along the entire breadth of panel 14. A back wall 45 extends from base 44 along the back side of panel 14, and a front lip 46 overlaps the front of panel 14. A rib 47 extends perpendicularly from base 44 into core 22 of panel 14 to secure the rail 27.

Toward the rear of base 44 is an upstanding, rearwardly curved ridge 49 providing a socket for accommodation of the rear, beaded foot 35 of first rail 26. Ridge 49 provides a socket for guided rotation of first rail 26 relative to second rail 27 about a horizontal axis generally in proximity to the interior of rear edges of lateral end 19 and 20 of the panels 14 and 15.

Adjacent panels 14 and 15 are highedly connected by suitable conventional means for relative rotation generally about the interior edges of facing lateral ends. A hinge 48 includes hinge plates 50 and 51 connected to the respective panels 14 and 15, the hinge plates 50, 51 being joined by a suitable hinge pin 52. Suitable fastening assemblies 53 connect the hinge plates 50, 51 to the panels 14, 15. Assemblies 53 may pass through a portion of the guard rails 26, 27 to additionally secure them to the door panels. Assemblies 53 can be Riv-nuts or bolts connected to expanded anchors used to attach both the rail assemblies 26 and 27 and the hinges 48 to the panels 14 and 15. Other types of fasteners or holding structures can be used for assemblies 53.

Located toward the forward edge of base 44 of second rail 27 is an upstanding, arcuate segment 56. The portion of base 44 ahead of segment 56 provides a sill 57 for receipt of the beaded front foot 31 of the first rail 26 when the rail assembly 21 is closed. Arcuate segment 56 extends from base 44 into the pocket 40 defined by the front and rear legs 36, 37 and platform 38 of first rail 26, and terminates in a downwardly extended lip 58. The forward facing contour of arcuate segment 56 is shaped to closely conform to the path of travel described by the forward beaded foot 31 of the first rail 26 as the first rail 26 is pivoted relative to the second rail 27. The path of travel so described by the forward beaded foot 31 will generally be an arc, wherein the arcuate segment 56 has a forward facing contour describing a portion of a circular arc. As illustrated in FIG. 3, where there is shown the adjacent panels 16 and 17 in pivoted relationship to one another and having assembled thereto a rail assembly 21 of the invention, and wherein like parts are designated by like reference numerals, the forward facing contour of arcuate segment 56 describes a contour wherein the forward beaded foot 31 of rail assembly 26 remains in close proximity to the contour of the arcuate segment 56. Arcuate segment 56 thus closes from a forward direction the pocket 40 and also the angular gap normally produced between the adjacent lateral ends of pivoting door panels. Arcuate segment 56 prevents the entry of fingers, dirt, dust, ice, and other foreign material, into the gap between the lateral edges 19, 20 of adjacent panels.

Referring to FIG. 4, the lower lateral end 60 of panel 14 is equipped with an end rail assembly 61 spanning the entire breadth thereof. End rail assembly 61 has a flat base 61 in abutting relationship to the end 60 of panel 14, and an upstanding back wall 63 extending upward along the rear of panel 14. A front lip 64 overlaps the front lower edge of panel 14. A rib 65 extends perpendicularly from the base 62 into the core 22 to secure the end rail assembly 61 in place. A pair of longitudinal channels 66, 66 are secured to the bottom of plate 62 in proximity to the front and rear edges thereof respectively. The channels 66, 66 accommodate end flanges 67, 67 of a resilient, semi-circular bumper member 68 such as rubber or the like. Bumper member 68 is in position to first contact the ground or other supporting surface upon closure of the door 10. Bumper member 68 absorbs any shock occasioned by the closing of the door as well as providing a weatherproof seal between the door and the ground.

In the use of the invention, a guard rail assembly 21 including first and second rails 26, 27 is assembled between facing lateral ends of adjacent, hingedly connected sectional panels of a sectional door. In the closed configuration of FIG. 2, the individual rails are in lateral alignment, the arcuate segment 56 of the second rail 27 extending into the pocket 40 defined by the first rail 26. The forward foot 31 rests in sealing engagement on the sill 57 defined by the second rail 27 wherein the rail assembly 21 shuts off the interior of the garage from the exterior. As shown in FIG. 3, upon opening of the garage door, as the panels negotiate the right angle turn provided on the garage door lifting rails, adjacent panels pivot relative to one another producing an angular gap between the lateral ends of adjacent panels. The first and second rails 26, 27 rotate relative to one another, the rear foot 35 of first rail 26 pivoting in the socket 49 of the second rail 27 and being slightly displaced therein. The forward beaded foot 31 of first rail 26 travels along an arcuate path conforming to the outer contour of arcuate segment 56. Arcuate segment 56 spans the angular gap produced between the lateral ends 19, 20 of the adjacent panels, thus closing the gap that would otherwise therein appear. The arcuate segment 56 prevents the entry of snow, sleet, ice, dirt, and the like, which would tend to clog the hinge mechanism and impede operation of the door. Upon closure of the door, the arcuate segment 56 is effective to additionally prevent entry of fingers therein which might be caught upon the closure of the angular gap produced between the lateral ends of the adjacent panels.

Any shock that may attend the closure of the door 10 is absorbed by the bumper 68 located on the bottom of panel 14. The bumper 68 also serves as a weather barrier and thermal barrier when the door 10 is closed.

The first and second rails 26, 27 and the end rail 61 lend a measure of rigidity, support and protection to the lateral ends of the respective door panels permitting the use of a door panel having an expanded foam core 22 protected by suitable barriers at the front and rear such as the metal skin 23 and the wood layer 25. Such a door panel is lightweight, thermally insulative, inexpensive and long-lasting. Suitable channel members (not shown) may readily be provided on the longitudinal ends of each door panel to complete a frame structure for each door panel.

While there has been shown and described a particular embodiment of a sectional door and guard rails according to the present invention, it will be apparent to those skilled in the art that certain deviations may be had from that embodiment shown without departing from the scope and spirit of the appended claims. For example, the door and guard rails can be used as door assemblies for vehicle bodies, as truck and van bodies, rear doors for pickup truck covers, and for buildings, as warehouses, machine sheds, livestock barns, and the like.

The embodiments of the invention in which an exclusive property or privilege is claimed are defined as follows:

1. A guard rail assembly for a sectional door of the type having a pluraltiy of panels with facing lateral ends of adjacent panels being hingedly connected and having interior and exterior edges, said panels being hingedly connected for relative rotation generally about the interior edges of the facing lateral ends between an aligned position and a rotated position, said guard rail assembly comprising: a first rail mounted to a lateral end of a first panel; a second rail mounted to a lateral end of a second panel adjacent the first panel facing the lateral end of the first panel; said first rail having front wall means extending from the exterior edge of the lateral end of the first panel and terminating in a front foot; said first rail having a pocket behind said front wall means openly facing said second rail; said pocket having a bottom area and a top area; said second rail having an arcuate segment extending to the bottom area of said pocket when the first and second panels are in the aligned position and extending into the top area of said pocket when the first and second panels are in the rotated position whereby the arcuate segment spans the gap between the lateral end of the second panel and the front foot of the front wall means of the first rail, said arcuate segment having an outside wall located adjacent the front foot when the panels are in either the aligned or rotated positions.

2. The guard rail assembly of claim 1 wherein: said second rail has base means in abutting relationship to the lateral end of the second panel, said base means providing a sill for receipt of the front foot of the front wall means of the first rail; said arcuate segment extending from said base means proximate the front foot of the front wall means.

3. The guard rail assembly of claim 2 wherein: said arcuate segment has a contour conforming to the path of travel of said front foot of the front wall means of the first rail in movement of the first and second panels between the aligned position and the rotated position.

4. The guard rail assembly of claim 3 including: rear wall means on said first rail extending from the interior edge of the lateral end of said first panel and terminating in a rear foot; socket means located on the base means of the second rail for accommodation of the rear foot of the first rail during relative rotation of the first and second panels.

5. The guard rail assembly of claim 4 wherein: the pocket of the first rail is defined by a first leg extending from the front foot toward the lateral end of the first panel, a second leg extending from the rear foot toward the lateral end of the first panel, and a platform in abutting relationship to the lateral end of the first panel and connecting the first and second legs.

6. The guard rail assembly of claim 5 including: rib means extended from the platform of the first rail into the first panel to secure the first rail to the first panel.

7. The guard rail assembly of claim 6 including: rib means extending from the base of the second rail into the second panel to secure the second rail to the second panel.

8. The guard rail assembly of claim 7 wherein: each panel has a core of an expanded plastic foam material, skin means covering the exterior surface of the core, and a wooden layer covering the interior surface of the core, said rib means of the first rail extended into the core of one panel and the rib means of the second rail extended into the core of another panel.

9. A guard rail assembly for a sectional door of the type having a plurality of panels with facing lateral ends of adjacent panels being hingedly connected and having interior and exterior edges, said panels being hingedly connected for relative rotation generally about the interior edges of the facing lateral ends between an aligned position and a rotated position, said guard rail assembly comprising: a first rail mounted to a lateral end of a first panel; a second rail mounted to a lateral end of a second panel adjacent the first panel facing the lateral end of the first panel; said first rail having front wall means extending from the exterior edge of the lateral end of the first panel, and a pocket behind said front wall means openly facing said second rail; said pocket having a bottom area and a top area; said second rail having a segment extending to the bottom area of said pocket when the first and second panels are in the aligned position and extending into the top area of said pocket when the first and second panels are in the rotated position whereby the segment spans the gap between the lateral end of the second panel and the front wall means of the first rail; said segment having an outside wall located adjacent the front wall means when the panels are in either the aligned or rotated positions.

10. The guard rail assembly of claim 9 wherein: said second rail has base means in abutting relationship to the lateral end of the second panel, said base means providing a sill engageable with a part of the front wall means of the first rail.

11. The guard rail assembly of claim 10 wherein: said segment has an arcuate contour conforming to the path of travel of the front wall means of the first rail in movement of the first and second panels between the aligned position and the rotated position.

12. The guard rail assembly of claim 9 including: rear wall means on said first rail extending from the interior edge of the lateral end of said first panel and terminating in a rear foot; socket means located on the base means of the second rail for accommodation of the rear foot of the first rail during relative rotation of the first and second panels.

13. The guard rail assembly of claim 9 wherein: the pocket of the first rail is defined by a first leg extending toward the lateral end of the first panel, a second leg extending toward the lateral end of the first panel, and a platform in abutting relationship to the lateral end of the first panel and connecting the first and second legs.

14. The guard rail assembly of claim 13 including: rib means extended from the platform of the first rail into the first panel to secure the first rail to the first panel.

15. The guard rail assembly of claim 6 including: rib means on the second rail extended into the second panel.

16. The guard rail assembly of claim 7 wherein: each panel has a core of an expanded plastic foam material, skin means covering the exterior surface of the core, and wooden layer covering the interior surface of the core, said rib means of the first rail extended into the core of one panel and the rib means of the second rail extended into the core of another panel.

* * * * *

UNITED STATES PATENT AND TRADEMARK OFFICE

CERTIFICATE OF CORRECTION

PATENT NO. : 3,941,180

DATED : March 2, 1976

INVENTOR(S) : Timothy N. Thill

It is certified that error appears in the above–identified patent and that said Letters Patent are hereby corrected as shown below:

Column 2, line 30, "hingely" should be --hingedly--.

Column 4, line 19, "flat base 61" should be --flat base 62--.

Signed and Sealed this

*fourth* Day of *May 1976*

[SEAL]

*Attest:*

RUTH C. MASON
*Attesting Officer*

C. MARSHALL DANN
*Commissioner of Patents and Trademarks*